US011066763B1

(12) United States Patent
Alexander et al.

(10) Patent No.: US 11,066,763 B1
(45) Date of Patent: Jul. 20, 2021

(54) KNITTING METHODS FOR INCREASED SEPARATION OF FABRIC LAYERS OF TETHERED SPACER FABRICS

(71) Applicant: GM GLOBAL TECHNOLOGY OPERATIONS LLC, Detroit, MI (US)

(72) Inventors: Paul W. Alexander, Ypsilanti, MI (US); Wonhee M. Kim, Royal Oak, MI (US); Neil Tagner, Taylorsville, NC (US); Jason R. Wilkins, Taylorsville, NC (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/853,876

(22) Filed: Apr. 21, 2020

(51) Int. Cl.
*D04B 1/22* (2006.01)
*D04B 21/20* (2006.01)

(52) U.S. Cl.
CPC ..... *D04B 1/22* (2013.01); *D04B 21/20* (2013.01)

(58) Field of Classification Search
CPC . D04B 1/10; D04B 1/102; D04B 1/22; D04B 7/04; D04B 7/045; D04B 7/14; D04B 9/16; D04B 21/06; D04B 21/20; D04B 23/10
See application file for complete search history.

(56) References Cited

U.S. PATENT DOCUMENTS 5,385,036 A * 1/1995 Spillane ..... A43B 1/04 2/16
5,589,245 A * 12/1996 Roell ..... D03D 27/10 428/85
5,651,847 A * 7/1997 Loeffler ..... D04B 1/16 66/19
5,896,758 A * 4/1999 Rock ..... A43B 23/0205 66/191
6,105,401 A * 8/2000 Chadeyron ..... D04B 1/22 66/195
6,156,406 A * 12/2000 Rock ..... B32B 5/12 428/86
6,196,032 B1 * 3/2001 Rock ..... D04B 21/02 442/304
6,755,052 B1 * 6/2004 Sytz ..... D04B 1/18 66/19
6,915,666 B2 * 7/2005 Willmer ..... D04B 9/06 66/19

(Continued)

*Primary Examiner* — Danny Worrell
(74) *Attorney, Agent, or Firm* — Harness, Dickey & Pierce, P.L.C.

(57) ABSTRACT

A method of forming a spacer fabric includes performing, via a knitting machine, an iterative process. The iterative process includes: knitting a tether from a first point to a second point on a first fabric layer; extending the tether from the second point to a third point on a second fabric layer to start formation of a tether segment; temporarily holding the tether at the third point via one of a temporary holding needles; extending the tether from the third point to a fourth point on the first fabric layer; temporarily holding the tether at the fourth point via another one of the temporary holding needles; extending the tether from the fourth point to a fifth point on the second fabric layer; and knitting the tether from the fifth point to a final point on the second fabric layer. The tether segment is released from the temporary holding needles.

20 Claims, 7 Drawing Sheets

(56) References Cited

U.S. PATENT DOCUMENTS 7,076,974 B1 * 7/2006 Chen ..... D04B 21/10 66/195
7,380,420 B1 * 6/2008 Liu ..... D04B 21/18 66/195
7,565,821 B2 * 7/2009 Park ..... B60N 2/976 66/195
7,788,952 B2 * 9/2010 Morrison ..... A41D 13/0025 66/195
7,913,520 B1 * 3/2011 Chen ..... D04B 1/16 66/196
8,286,451 B2 * 10/2012 Mueller ..... D04B 21/16 66/195
8,343,609 B2 * 1/2013 Crawford ..... B32B 13/14 428/70
9,375,049 B2 * 6/2016 Hazenberg ..... A43B 13/20
9,677,209 B2 * 6/2017 Daube ..... D04B 21/20
2002/0104335 A1 * 8/2002 Shirasaki ..... D04B 21/16 66/196
2003/0033838 A1 * 2/2003 Ikenaga ..... D04B 21/16 66/196
2003/0101776 A1 * 6/2003 Shirasaki ..... D04B 21/12 66/196
2004/0097148 A1 * 5/2004 Tucker, Jr. ..... D03D 15/247 442/205
2004/0097151 A1 * 5/2004 McMurray ..... D04B 1/246 442/304
2006/0185401 A1 * 8/2006 Shirasaki ..... D04B 21/14 66/203
2007/0238392 A1 * 10/2007 Starbuck ..... D04B 21/207 450/1
2010/0154482 A1 * 6/2010 Abramo ..... D04B 15/80 66/8
2012/0330093 A1 * 12/2012 Odermatt ..... A61F 2/0063 600/30
2018/0187348 A1 * 7/2018 Mueller ..... D04B 21/14
2020/0240055 A1 * 7/2020 Mueller ..... D04B 21/20
2020/0340152 A1 * 10/2020 Mueller ..... D04B 21/04

* cited by examiner

KNITTING METHODS FOR INCREASED SEPARATION OF FABRIC LAYERS OF TETHERED SPACER FABRICS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to knitting methods for forming spacer fabrics.

Spacer fabrics are used in various applications to provide increased fabric thickness. As a few examples, spacer fabrics are used in clothing (e.g., shirts, sweaters, jerseys, and shoes), rafts, inflatable boats, etc. A spacer fabric can include a front fabric layer and a back fabric layer, which is connected to the front fabric layer by one or more tethers. As an example, the space between the front fabric layer and the back fabric layer may be filled with a material (e.g., resin or other suitable filler material) and/or air to maintain a separation between the front fabric layer and the back fabric layer, hence the name "spacer fabric". Depending on the materials used, the resulting spacer fabric may have a composite structure. The tethers can hold the front fabric layer relative to the back tether bed and provide increased strength and durability. The tethers can also provide increased rigidity when the front and back fabric layers are held spaced apart.

SUMMARY

A method of forming a spacer fabric is provided and includes performing, via a knitting machine, an iterative process multiple times to form tether segments, the iterative process includes: knitting a tether from a first point to a second point on a first fabric layer; extending the tether from the second point to a third point on a second fabric layer to start formation of one of the tether segments; temporarily holding the tether at the third point via one of a temporary holding needles; extending the tether from the third point to a fourth point on the first fabric layer; temporarily holding the tether at the fourth point via another one of the temporary holding needles; extending the tether from the fourth point to a fifth point on the second fabric layer to complete formation of the one of the tether segments; and knitting the tether from the fifth point to a final point on the second fabric layer. The method further includes releasing the tether segments from the temporary holding needles to allow a distance between the first fabric layer and the second fabric layer to increase.

In other features, the iterative process includes temporarily holding the one of the tether segments at only two temporary holding needles.

In other features, the iterative process comprises temporarily holding the one of the tether segments at more than two temporary holding needles.

In other features, the first fabric layer, the second fabric layer and the tether segments are formed of a same material.

In other features, at least one of: the tether segments are formed of a different material than the first fabric layer and the second fabric layer; or some of the tether segments are formed of a different material than other ones of the tether segments.

In other features, the iterative process includes: determining a first number of needles to knit the tether on the first fabric layer; determining a second number of needles to knit the tether on the second fabric layer; knitting the tether to the first fabric layer using the first number of needles; and knitting the tether to the second fabric layer using the second number of needles.

In other features, the iterative process includes: determining a number of needles the third point is to be offset from the second point; and extending the tether from the second point to the third point based on the number of needles.

In other features, the iterative process includes: determining a number of needles the fourth point is to be offset from the third point; and extending the tether from the third point to the fourth point based on the number of needles.

In other features, the iterative process includes: determining a number of needles the fifth point is to be offset from the fourth point; and extending the tether from the fourth point to the fifth point based on the number of needles.

In other features, a different tether is used for each iteration of the iterative process.

In other features, the tether is knitted to: every other one of a portion of needles in a first bed of needles corresponding to the first fabric layer; and every other one of a portion of needles in a second bed of needles corresponding to the second fabric layer.

In other features, a method of forming a spacer fabric is provided. The method includes performing, via a knitting machine, an iterative process a multiple times to form tether segments, the iterative process includes: attaching a tether at a first point on a first fabric layer; knitting the tether from the first point to a second point on the first fabric layer; extending the tether from the second point to a third point to form one of the plurality of tether segments, wherein the third point is laterally offset from the second point and is on a second fabric layer; attaching the tether at the third point; extending the tether from the third point back to the second point on the first fabric layer to form a second one of the tether segments; attaching the tether at the second point; and knitting the tether from the second point to a final point on the second fabric layer. The method further includes shifting the first fabric layer relative to the second fabric layer to: increase angles between (i) the plurality of tether segments and (ii) the first fabric layer and the second fabric layer; and allow distance between the first fabric layer and the second fabric layer to increase.

In other features, a same tether is used for each iteration of the iterative process.

In other features, the tether segments are angled is a same direction relative to the first fabric layer and the second fabric layer.

In other features, the first fabric layer, the second fabric layer and the tether segments are formed of a same material.

In other features, at least one of: the tether segments are formed of a different material than the first fabric layer and the second fabric layer; or some of the tether segments are formed of a different material than other ones of the tether segments.

In other features, the method further includes forming maintaining predetermined distances between edges of the first fabric layer and the second fabric layer and the tether segments to allow non-tethered end portions of the first fabric layer and the second fabric layer to be folded over and stitched.

In other features, the non-tethered end portions form end surfaces of the spacer fabric when the spacer fabric is in an erected state.

In other features, the iterative process further includes: determining a number of needles the second point is to be offset from the first point; and extending the tether from the first point to the second point based on the number of needles.

In other features, the iterative process further includes: determining a number of needles between sets of tether segments; and extending the tether between the first point and the second point for iterations of the iterative process, other than a first iteration of the iterative process, based on the number of needles.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
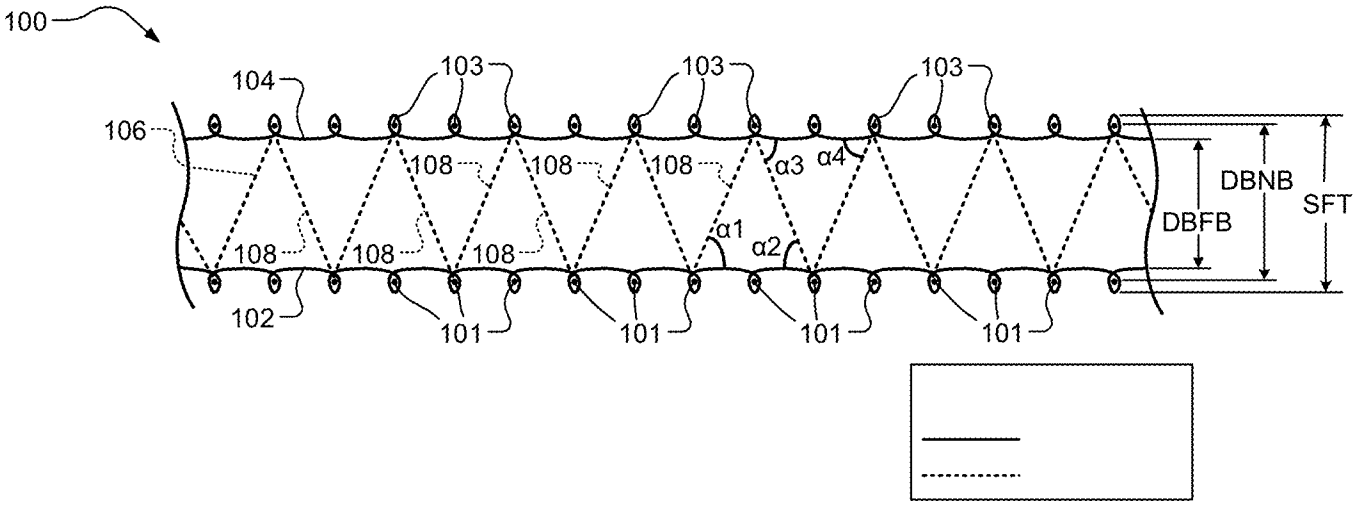
FIG. 1 (Prior Art)
FIG. 1 is a top view of a portion of a knitting machine illustrating a spacer fabric formed using a traditional method.

An example of a spacer fabric 100 is shown in FIG. 1 and a corresponding knitting method is described below. FIG. 1 shows a portion of a knitting machine including a first bed of needles 101 and a second bed of needles 103. The spacer fabric 100 includes a front fabric layer 102, a back fabric layer 104 and one or more tethers (one tether 106 is shown) connecting the front fabric layer 102 to the back fabric layer 104. As an example, a first yarn is knitted via the first bed of needles 101 to provide the front fabric layer 102. The same yarn or a second yarn is knitted via the second bed of needles 103 to form the back fabric layer 104. A third yarn is extended between the fabric layers 102, 104 to provide the tether 106 including tether segments 108 extending between the fabric layers 102, 104. Yarn refers to a collection of fiber used to weave or knit into a textile fabric. The material (or yarn) of the fabric layers 102, 104 may be the same or different than the material of the tether 106. The tether 106 is extended in a "zig-zag" pattern between the fabric layers 102, 104. The tether is tuck stitched to the fabric layers at various points in a knitting course (row of stitches).

A tuck stitch may include a held loop, one or more tuck loops and knitted loops. It may be produced when a needle holding a first (or the held) loop also receives a second (or new) loop, which becomes a tuck loop because the second loop is not intermeshed through the held loop but rather is tucked in behind the held loop on a reverse side of the corresponding stitch. Side limbs of the second loop are therefore not restricted at feet of the side loop by a head of the held loop, which allows the limbs to open outwards towards two adjoining needle loops formed in the same course. The tuck loop assumes an inverted V or U-shaped configuration. Yarn passes from sinker loops to the head that is intermeshed with the second (or new) loop of a course above it, such that the head of the tuck is on the reverse of the stitch.

As another example, a tuck stich may include a needle of a needle bed lifting up to grab newly provided yarn. The newly provided yarn is tucked under a previous stitch. During this process, the needle is lifted slightly to grab a tether (the newly introduced yarn) and then the needle is let back down, such that when the needle knits a next course of yarn for the corresponding fabric layer, the tether is locked into the knitted yarn.

The spacer fabric 100 has a spacer fabric thickness (SFT) and a distance between fabric layers (DBFB). As an example, the DBFB may be 3-5 millimeters (mm). The DBFB is limited by a structural distance between the beds of needles 101, 103, referred to as the distance between needle beds (DBNB). In an attempt to overcome this limitation, (i) a significant amount of yarn may be packed into the spacer fabric to increase the SFT, and/or (ii) the material of the fabric layers 102, 104 may be shrinkable and the material of the tether may not be shrinkable. The fabric layers 102, 104 may be formed of shrinkable material to bring the stitches of the fabric layers closer together in a lateral direction, which increases angles between the segments 108 of the tether 106 to increase space between the fabric layers 102, 104 and as a result increase thickness of the spacer fabric 100. Example angles $\alpha 1$-$\alpha 4$ are shown and are equal in size. Each segment 108 extends from a first tucked location on the front fabric layer 102 to a second tucked location on the back fabric layer 104. These techniques are however limited in the amount of overall thickness gained.

The above-stated example knitting method corresponding to the spacer fabric 100 does not include precise control of distances between the fabric layers 102, 104 and/or precise control of distances between the fabric layers 102, 104 at specific coordinate locations across the fabric layers 102, 104. This is especially true due to non-uniform shrinkage of materials.

The examples set forth herein include techniques for manufacturing spacer fabrics having increased thicknesses. One of the example techniques includes forming angled dual tether segments of increased length and shifting fabric layers relative to each other to provide increased distance between the fabric layers. Another one of the example techniques includes forming half gauge tethers and releasing temporarily held portions of the tethers to provide increased distances between fabric layers without shifting the fabric layers relative to each other. The examples allow thicknesses to be selected and corresponding spacer fabrics to be formed. For example the lengths of formed tether segments are selectable and are able to be increased over traditional methods. The examples disclosed herein are not limited by distances between needle beds of a knitting machine and allow for forming spacer fabrics having thickness of up to and greater than 38.1 mm (or 1.5 inches). The spacer fabrics disclosed herein are applicable to vehicle and non-vehicle implementations, some of which are referred to herein.

Figure 2:
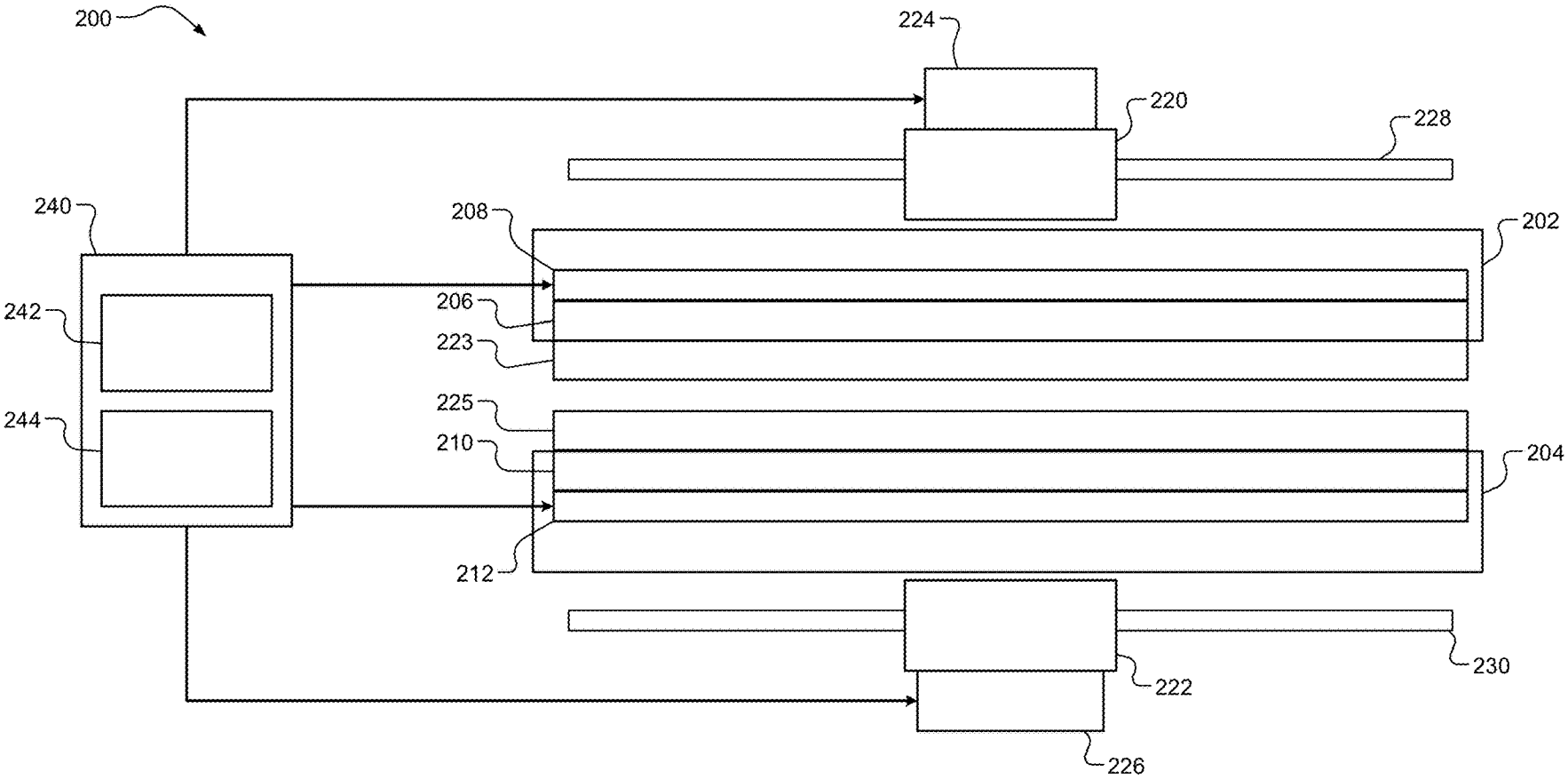
FIG. 2 is a functional block diagram of a knitting machine in accordance with the present disclosure.

FIG. 2 shows an example knitting machine 200. The knitting machine 200 may be a 3-D knitting machine, a 4-D knitting machine, a circular knitting machine, or other suitable knitting machine. FIG. 2. is provided for example purposes only. The knitting machine 200 may include different components and/or a different number of each component than as shown. The knitting machine 200 may be arranged differently and/or have a different configuration than as shown.

The knitting machine 200 is a V-bed knitting machine having two needle beds located across from each other. As shown, the knitting machine 200 includes a first needle bed assembly 202 and a second needle bed assembly 204. The first needle bed assembly 202 includes a first bed of needles 206 and first needle actuators 208. The second needle bed assembly 204 includes a second bed of needles 210 and second needle actuators 212. The beds of needles 206, 210, which are referred to as needle beds, include needles (e.g., 50-100 needles per bed) that are actuated (e.g., lifted and set back down and/or otherwise moved) via the needle actuators 208, 212. Examples of the needles are shown in FIGS. 3A, 3B, 5A, 5B. The needle actuators 208, 212 may include motors, rollers, cams, links, pulleys and/or other components for moving the needles 206, 210. The needle beds 206, 210 may form a "V" near a top of the needle beds 206, 210, where the needle beds 206, 210 come close together and between which a tether may extend.

The knitting machine 200 also includes one or more fabric feeders; a first fabric feeder 220 and a second fabric feeder 222 are shown. Although the feeders 220, 222 are shown on sides of the needle bed assemblies 202, 204, one or more of the feeders 220, 222 may be located above and/or offset from the needle bed assemblies 202, 204. The fabric feeders 220, 222 are used to feed yarn to the needles of the needle beds 206, 210 while knitting courses of fabric layers; a first fabric layer 223 and a second fabric layer 225 are shown. One of the feeders 220, 222 may be used to feed yarn for tethers or another designated tether feeder may be used. The tether feeder may be above and/or between the needle bed assemblies 202, 204. A same fabric feeder may be used to feed both of the needle beds 206, 210. As an example, the fabric feeder may move left to right to provide yarn for the first needle bed 206 and then may move right to left to feed the second needle bed 210 when making a tubular object (e.g., a sock).

The fabric feeders 220, 222 may include feeder actuators 224, 226, which are used to, for example, move the fabric feeders 220, 222 and/or components thereof to move the feeders 220, 222 along tracks 228, 230 and/or to feed yarn to the needle beds 206, 210. The fabric feeders 220, 222 and/or feeder actuators 224, 226 may include motors, rollers, pulleys, links, brackets, cones, spindles, guides, etc. The feeders 220, 222 and/or other feeders of the knitting machine may supply yarn of various types. The yarn may include monofilaments to create loft and/or increase thickness. The yarn may include shrinkable and/or non-shrinkable yarn.

The needle actuators 208, 212 and the feeder actuators 224, 226 may be controlled by a control module 240. The control module 240 includes a dual tether segment module 242 and a half gauge tether module 244. The dual tether segment module 242 implements a first method described with respect to FIGS. 3A, 3B and 4. The half gauge tether module 244 implements a second method described with respect to FIGS. 5A, 5B and 6.

Figure 3A:
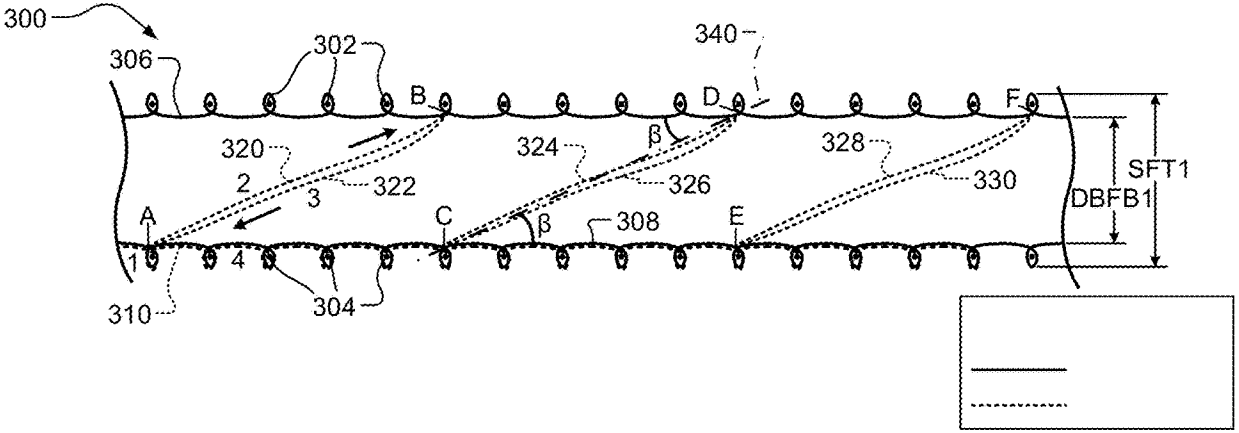
FIG. 3A is a top view of a portion of the knitting machine of FIG. 2 illustrating spacer fabric formation including sets of dual tether segments in accordance with an embodiment of the present disclosure.

FIG. 3A shows a portion 300 of the knitting machine 200 of FIG. 2 illustrating spacer fabric formation including sets of dual tether segments. The portion 300 includes first needles 302 of the first needle bed 206 of FIG. 2 and second needles 304 of the second needle bed 210 of FIG. 2. Yarn of a course of a first fabric layer (e.g., fabric layer 223) on the first needles 302 is designated 306. Yarn of a course of a second fabric layer (e.g., fabric layer 225) on the second needles 304 is designated 308. One or more tethers extend between the course of the first fabric layer and the course of the second fabric layer. A single tether 310 is shown. The material of the fabric layers may be the same or different than the tethers. The material of the tethers may be the same or different. For example, some of the tethers may be formed of a different material than other ones of the tethers. Tethers of a single textile and/or tethers of a single knitting course may be formed of different materials.

The tether 310 is knit stitched to the second fabric layer and is tuck stitched to the first fabric layer at certain predetermined locations. A knit stitch may refer to the action of inserting needles through a bottom of a first loop and pulling a new loop down and through the first loop. Example types of knit stitches are a stockinette stitch, a reverse stockinette stitch, a garter stitch, a slip stitch, and a seed stitch. A knit stitch may be referred to as a non-tuck stitch. The needles 302, 304 may knit or not and the unknitted yarn portions may lie under or over the needles 302, 304. The held unknitted yarn may be used to form tuck stitches. Forming of the tether is further described below with respect to the method of FIG. 4. During this method sets of dual tether segments are formed. Example sets including pairs of tether segments (first pair 320, 322, second pair 324, 326 and third pair 328, 330) are shown. The tether segments 320, 322, 324, 326, 328, 330 are angled in a same direction. In one embodiment, the tether segments 320, 322, 324, 326, 328, 330 and/or the corresponding paths of extension are parallel to each other.

Although a single tether is shown and is used to form multiple sets of dual tether segments, multiple tethers may be used to form the sets of dual tether segments. For example, instead of performing a continuous stitch on the second fabric layer between sets of dual tether segments, a tether may not be disposed and/or extended between a predetermined number of needles between successive sets of dual tether segments. As a result, a tether may not be stitched to the second fabric layer using a predetermined number of needles between the sets of dual tether segments. For example, a tether may not be stitched using a predetermined number of needles between the set of tether segments 324, 326 and the set of tether segments 328, 330. Each tether used may form a predetermined number of sets of tether segments for a single course of fabric formed on the needles 302, 304 of the first needle bed and the second needle bed. For each set of tether segments formed, the corresponding tether may be stitched to the second fabric using a predetermined number of needles prior to the set of tether segments and a predetermined number of needles after the tether segments.

An example angled linear path of one of the sets of dual tether segments is illustrated by line 340 and extends between tuck points at the fabric layers. Example tuck points are designated A, B, C, D, E, F. The line 340 is at acute angles 13 relative to the fabric layers. A predetermined selected number of needles may exist between tuck points of adjacent sets of tether segments. The number of needles between successive tuck points may be the same or different. Also, a first tuck point of a tether segment may be laterally offset from a second tuck point of the same tether segment by a predetermined selected number of needles. The larger the offset, the longer the resultant sets of tether segments extending between the fabric layers. In an embodiment, the amount of offset for each tether segment extending between fabric beds is the same. As an example, the tether segment 320 has the tuck points A and B, where B is offset from A by 5 needles.

Figure 3B:
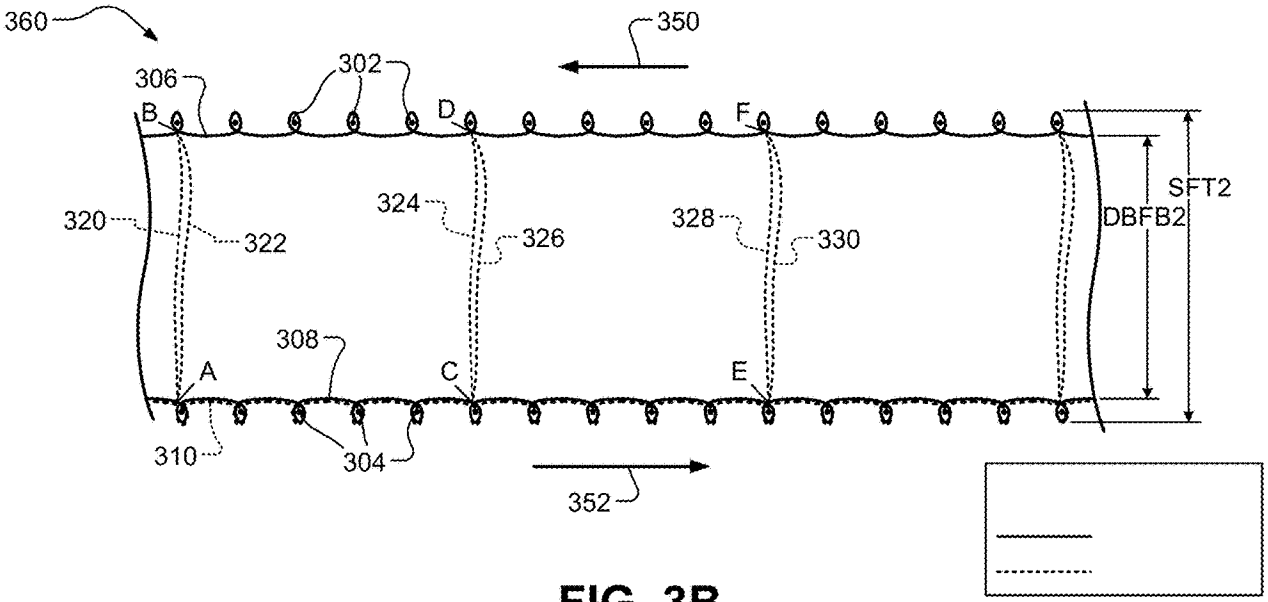
FIG. 3B is a top view of a portion of the spacer fabric of FIG. 3A in an erected (or fully separated) state in accordance with an embodiment of the present disclosure.

FIG. 3B shows a portion 360 of the spacer fabric of FIG. 3A in an erected (or fully separated) state. The portion 360 includes the first needles 302 and second needles 304. The yarn of the course of the first fabric bed on the first needles 302 is designated 306. The yarn of the course of the second fabric layer on the second needles 304 is designated 308. The tether 310 extends between the course of the first fabric layer and the course of the second fabric layer and the corresponding tether segments 320, 322, 324, 326, 328, 330 are shown in fully extended (or erected) states.

Subsequent to forming the sets of tether segments, the fabric layers may be removed from the knitting machine and shifted relative to each other, as represented by arrows 350, 352, to increase angles between the tether segments and the fabric layers. The fabric layers may be shifted laterally relative to each other, such that the angles between the tether segments 320, 322, 324, 326, 328, 330 are approximately perpendicular to the fabric layers thereby maximizing distances between the fabric layers. As can be seen in FIG. 3A, the spacer fabric has a first spacer fabric thickness SFT1 and a first distance between fabric layers DBFB1 when in a non-erected state during knitting. As can be seen in FIG. 3B, the spacer fabric has a second spacer fabric thickness SFT2 and a second distance between fabric layers DBFB2 when in an erected state subsequent to knitting. The resulting DBFB2 is equal to the lengths of each of the tether segments. Opposing ends of the courses of material may or may not be stitched together prior to shifting. The first tether segment and the last tether segment of a tether may be located predetermined distances away from edges of the fabric layers to allow for stitching of the ends and/or shifting of the fabric layers. This is further described below with respect to FIGS. 7-9.

Figure 4:
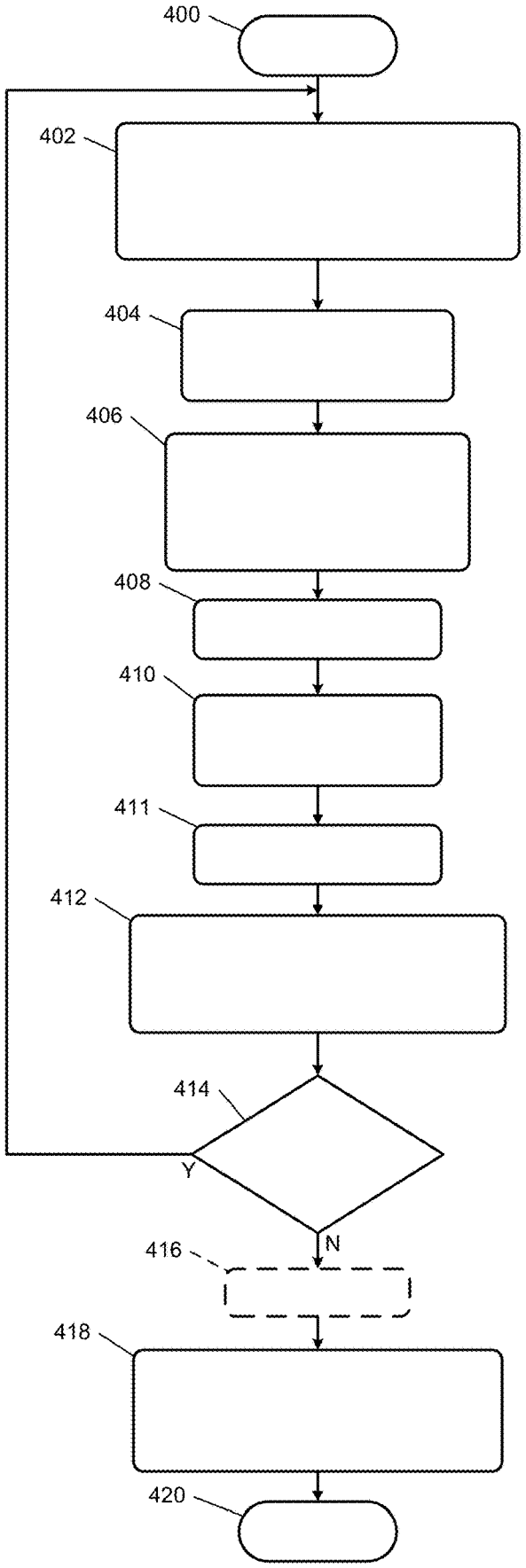
FIG. 4 illustrates a knitting method for forming the spacer fabric of FIGS. 3A-3B in accordance with an embodiment of the present disclosure.

The technique of FIGS. 3A, 3B and 4 allows for greater distances between fabric layers than there is distance between needle beds. The distance between the fabric layers may be, for example, 3-4 times the distance between the needle beds. This may be accomplished with no shrink in materials. Machine time is increased from the method used to form the spacer fabric in FIG. 1 due to the feeder attaching the tether being required to move forwards and backwards between tuck points, as opposed to being able to move in a single direction (e.g., a left to right direction) to extend a tether to tuck points, as in the method associated with FIG. 1.

FIG. 4 shows a knitting method for forming the spacer fabric of FIGS. 3A-3B. Although the following operations are primarily described with respect to the implementations of FIGS. 2-4, the operations may be easily modified to apply to other implementations of the present disclosure. Some or all of the operations may be controlled by the dual tether segment module 242 and may be iteratively performed. The operations may include the dual tether segment module 242 controlling a fabric feeder to feed yarn for one or more tethers and extending the tethers between attachment points (knitting and/or tuck points) and/or needles.

The method may begin at 400. At 402, the dual tether segment module 242 attaches a tether at a first point on a first fabric layer for a current course of fabric or, if another iteration of this process is being performed for the same tether, continues knitting the tether to the first fabric layer. The first point may refer to a first needle associated with the first fabric layer.

At 404, the dual tether segment module 242 knits the tether from the first point to a second point (or second needle) on the first fabric layer. An example of this portion of the tether yarn is next to numerical designator 1 in FIG. 3A.

At 406, the dual tether segment module 242 extends the tether from the second point to a third point on the second fabric layer laterally offset from the second point. An example of this portion of the tether yarn is next to numerical designator 2 in FIG. 3A.

At 408, the dual tether segment module 242 attaches the tether at the third point (e.g., the point designated B in FIG. 3A). This may be done using a tuck stitch.

At 410, the dual tether segment module 242 extends the tether back to the second point. This forms the second tether segment of the current set and is next to numerical designator 3 in FIG. 3A. At 411, the dual tether segment module 242 is attached at 411 using for example a tuck stitch.

At 412, the dual tether segment module 242 knits the tether to the second fabric layer from the second point to a final point associated with the current iteration of operations 402, 404, 406, 408, 410, 411, 412, 414. This portion of the tether yarn is next to numerical designator 4 in FIG. 3A.

At 414, the dual tether segment module 242 determines whether another dual tether segment (or set of tether segments) is to be formed using the current tether or using another tether. The dual tether segments refer to the two tether segments in a particular set of tether segments. If yes, operation 402 is performed, otherwise operation 416 may be performed. Prior to performing operation 416, the fabric layers may be removed from the stitching machine.

At 416, the dual tether segment module 242 or other module may control stitching of ends of the fabric layers. Examples of stitching ends of fabric layers is described with respect to FIGS. 7-9.

At 418, the fabric layers are shifted laterally relative to each other and away from each other to increase distances between the fabric layers as shown in FIG. 3B. This may include filling the gap between the fabric layers with a material and/or air. The method may end at 420.

The above-described operations are meant to be illustrative examples. The operations may be performed sequentially, synchronously, simultaneously, continuously, during overlapping time periods or in a different order depending upon the application. Also, any of the operations may not be performed or skipped depending on the implementation and/or sequence of events.

Figure 5A:
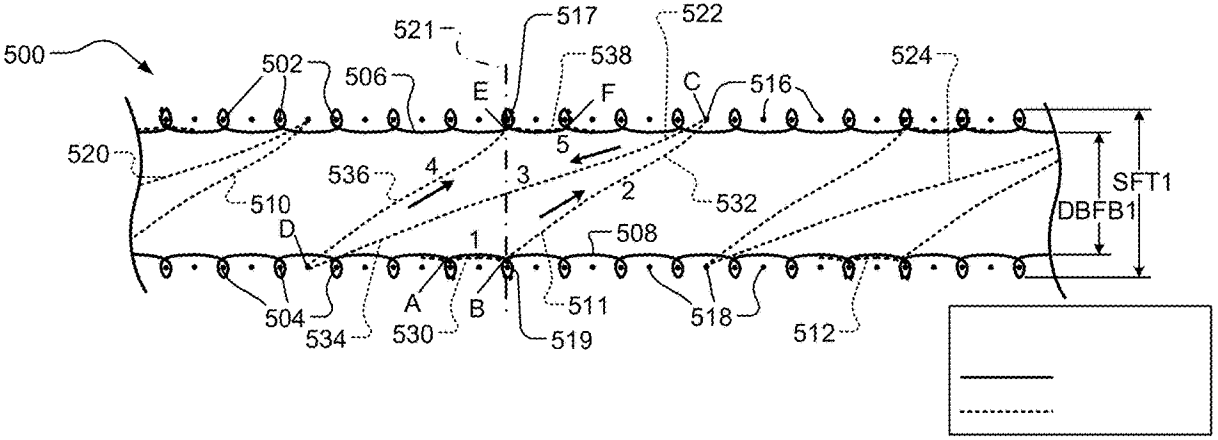
FIG. 5A is a top view of a portion of the knitting machine of FIG. 2 illustrating spacer fabric formation having half gauge tethers in accordance with an embodiment of the present disclosure.

FIG. 5A shows a portion 500 of the knitting machine 200 of FIG. 2 illustrating spacer fabric formation having a half gauge tethers. The portion 500 includes first needles 502 of the first needle bed 206 of FIG. 2 and second needles 504 of the second needle bed 210 of FIG. 2. Yarn of a course of a first fabric layer (e.g., first fabric layer 223) on a portion of the first needles 502 is designated 506. Yarn of a course of a second fabric layer (e.g., fabric layer 225) on a portion of the second needles 504 is designated 508. The material of the fabric layers may be the same or different than the tethers. The material of the tethers may be the same or different. For example, some of the tethers may be formed of a different material than other ones of the tethers. Tethers of a single textile and/or tethers of a single knitting course may be formed of different materials.

In one embodiment, every other needle of each of the needle beds is used for stitching and as a result the fabric layers have a half gauge construction. Multiple tethers 510, 511, 512 extend between the course of the first fabric layer and the course of the second fabric layer. In the example shown, the tethers 510, 511, 512 are half gauge tethers because portions of the tethers 510, 511, 512 are knitted using corresponding portions of the every other needle as shown. Some of the non-knitting needles are used to temporarily hold the tethers 510, 511, 512.

The tethers 510, 511, 512 are knit stitched to the first fabric layer and the second fabric layer. Points of the tethers 510, 511, 512 are temporarily held at certain locations on the first fabric layer and the second fabric layer and then later released to increase distances between the first fabric layer and the second fabric layer. The temporary hold locations are at needles, which are not being used for knitting portions of the fabric layers. As an example, every other one of the needles of the first needle bed and every other one of the needles of the second needle bed may not be used for knitting portions of the fabric layers, as shown. Needles that do not include yarn shown wrapped around them in FIGS. 5A and 5B, such as needles 516, 518, are not being used for knitting in the example shown.

In the example shown, two points of the tether 511 are temporarily held; one at each of the first needle bed and the second needle bed. These two needles (or points) are designated as C and D in FIG. 5A. Although the tether 511 is shown as being temporarily held at two points, the tether 511 may also be held at one or more other points at each of the needle beds, such as at other ones of the non-knitting needles. Holding the tether 511 at the temporary holding points (or needles) provides increased tether segment length and aids in keeping the portions of the tether that extend between the fabric layers from contacting the needle beds and/or interfering with knitting.

Figure 5B:
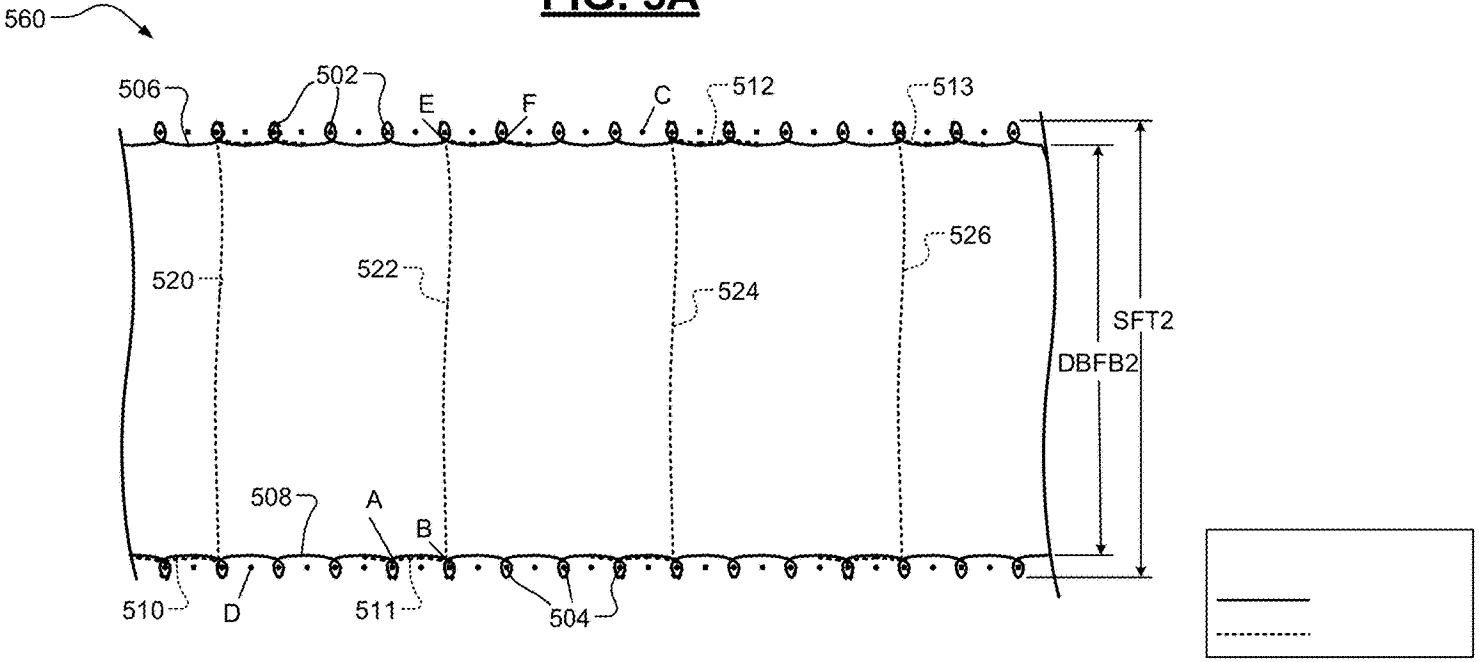
FIG. 5B is a top view of the spacer fabric of FIG. 5A in an erected (or fully separated) state in accordance with an embodiment of the present disclosure.

The temporarily holding needles may be a predetermined selected number of needles away from the two needles from which a tether segment transitions from knitted points and extends between fabric layers. In the example shown, the two needles are directly opposing knitting needles. Two directly opposing knitting needles are designated as 517, 519. Although the needles 517, 519, at which the tether extends between the fabric layers, are shown as being directly opposite each other, the needles 517, 519 may be laterally offset from each other. By having the needles 517, 519 directly opposite each other, the resulting distance between the fabric layers is maximized when the temporary holding points of the tether 511 are released. An example linear path 521 between the opposing needles 517, 519 is shown. This is further described below with respect to the method of FIG. 5. During this method elongated single tether segments are formed that are spaced apart. Example tether segments 520, 522, 524 of the tethers 510, 511, 512 are shown in FIGS. 5A and 5B. The tether segments 520, 522, 524 extend between the fabric layers. In FIG. 5A, the tether segments 520, 522, 524 are shown in temporarily held states. In FIG. 5B, the tether segments 520, 522, 524 are shown in erected states.

In FIG. 5A, the tether segments 520, 522, 524 include sub-segments. As an example, sub-segments of the tether segment 522 are designated 530, 532, 534, 536, 538. The sub-segments 530, 538 are knitted to the fabric layers, respectively. The sub-segments 530, 538 may be knitted to the fabric layers using a predetermined number of needles of the needles 502, 504. The sub-segments 532, 536 extend between the fabric layers and the temporary hold points C, D. Each of the sub-segments 532, 536 may be held by a predetermined number of temporary hold needles (non-knitting needles). The sub-segment 534 extends between the temporary hold points C, D. The number needles between the closest two temporary hold needles is predetermined. The more needles between the closest two temporary hold needles, the longer the resulting tether segment. In the example show, there are 13 needles between the temporary hold needles at the points C and D. In other words, the needle at point C is offset from the needle at point D by 14 needles. The number of needles between two knitting needles from which a tether segment extends between the fabric layers (e.g., the needles 517, 519) and the two closest temporary holding needles (e.g., the needles at points C, D) are also predetermined. The more predetermined number of needles between the two knitting needles and the closest temporary holding needles, the longer the tether segment.

FIG. 5B shows a portion 560 of the spacer fabric of FIG. 5A in a fully erected (or fully separated) state. The portion 560 includes the first needles 502 and second needles 504. The yarn of the course of the first fabric layer on the first needles 502 is designated 506. The yarn of the course of the second fabric layer on the second needles 504 is designated 508. Tethers 510, 511, 512, 513 are shown having the tether segments 520, 522, 524, 526. The tether segments 520, 522, 524, 526 extend between the course of the first fabric layer and the course of the second fabric layer and are shown in fully extended (or erected) states.

Subsequent to forming the tether segments 520, 522, 524, 526, the temporary holding needles are released and the fabric layers are removed from the knitting machine. As a result of the temporary holding needles being released, the fabric layers are able to be moved apart to straighten the tether segments 520, 522, 524, 526 as shown in FIG. 5B. As can be seen in FIG. 3A, the spacer fabric has a first spacer fabric thickness SFT1 and a first distance between fabric layers DBFB1 when in a non-erected state during knitting. As can be seen in FIG. 3B, the spacer fabric has a second spacer fabric thickness SFT2 and a second distance between fabric layers DBFB2 when in an erected state subsequent to knitting. The resulting DBFB2 is equal to the lengths of each of the tether segments 520, 522, 524, 526 and is also equal to a sum of the lengths of the sub-segments 532, 534, 536 of FIG. 5A. The ends of the courses of material may or may not be stitched together.

Figure 6:
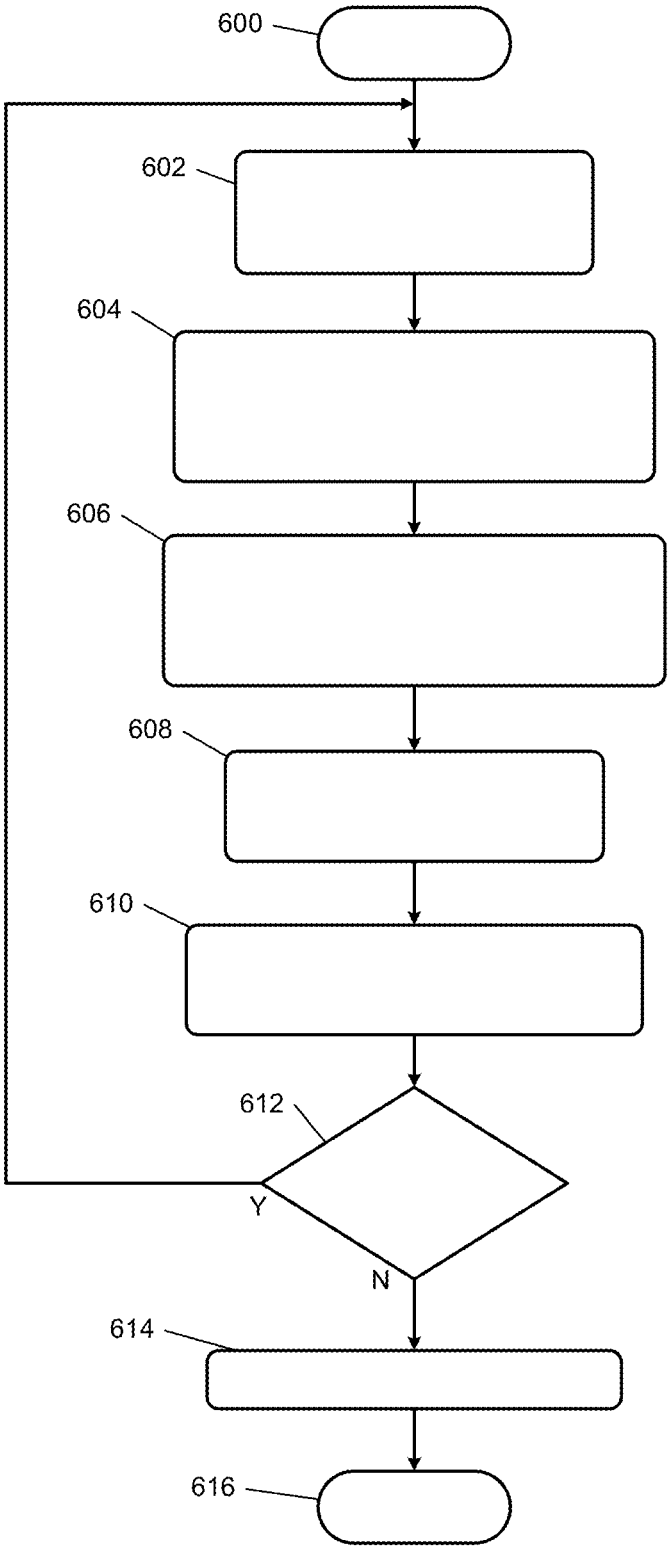
FIG. 6 illustrates a knitting method for forming the spacer fabric of FIGS. 5A-5B in accordance with an embodiment of the present disclosure.

The technique of FIGS. 5A, 5B and 6 allows for greater distances between fabric layers than there is distance between needle beds. The distance between the fabric layers may be multiple times the distance between the needle beds.

This may be accomplished with no shrink in materials. Machine time is increased from the method used to form the spacer fabric in FIG. 1 due to the feeder attaching tethers being required to move forwards and backwards between tuck points, as opposed to being able to move in a single direction to extend a tether to tuck points, as in the method associated with FIG. 1.

The spacer fabric of FIGS. 5A and 5B has a reduced knit density as compared to the spacer fabric of FIGS. 3A and 3B due to the half gauge construction. The half gauge construction of the spacer fabric allows for non-knitted needles on front or back fabric layers to be used as temporary hold tether points, which may be ultimately cast off (i.e. released). This allows for increased tether length between fabric layers with no shrink or shift between fabric layers being required. The locations of the tethers and tether segments in X and Y directions and the lengths of the tether segments (Z direction or distance between fabric layers) are able to be precisely controlled. The locations of the tethers and tether segments and the lengths of the tether segments (also referred to as the depth of the spacer fabric) are independent of one another. Spacing between tether segments may be predetermined, selected, consistent and/or vary for a single spacer fabric.

FIG. 6 illustrates a knitting method for forming the spacer fabric of FIGS. 5A-5B. Although the following operations are primarily described with respect to the implementations of FIGS. 2, 5A, 5B and 6, the operations may be easily modified to apply to other implementations of the present disclosure. Some or all of the operations may be controlled by the half gauge tether module 244 and may be iteratively performed. The operations may include the half gauge tether module 244 controlling a fabric feeder to feed yarn for the tether and extend the tether between attachment points (knitting or holding points) and/or needles.

The method may begin at 600. At 602, the half gauge tether module 244 knits a tether to a first fabric layer from a first point (e.g., point A) to a second point (e.g., point B) via knitting needles of the first needle bed.

At 604, the half gauge tether module 244 extends the tether from the second point to a third point (e.g., point C) at a second fabric layer and temporarily holds the tether at the third point via a temporary hold needle of the second needle bed. The tether may be temporarily held at more than one point (or needle) of the corresponding second needle bed.

At 606, the half gauge tether module 244 extends the tether from the third point back to a fourth point (e.g., point D) at the first fabric layer and temporarily holds the tether at the fourth point via a temporarily hold needle of the first needle bed.

At 608, the half gauge tether module 244 extends the tether from the fourth point to a fifth point (e.g., point E) on the second fabric layer. At 610, the half gauge tether module 244 knits the tether from the fifth point to a final point (e.g., point F) on the second fabric layer.

At 612, the half gauge tether module 244 determines whether to form another tether. If yes, operation 602 may be performed, otherwise operation 614 may be performed.

At 614, the half gauge tether module 244 the one or more tethers and corresponding tether segments are released from the temporary hold needles. The spacer fabric may then be removed from the knitting machine and the fabric layers may be further separated due to lengths of the formed tether segments. This may include filling the gap between the fabric layers with a material and/or air. The method may end at 616.

In one embodiment, instead of forming multiple separate tethers having respective tether segments extending between fabric layers, a single tether is used to form the tether segments. After each iteration of the above-described method, the tether is knitted along the fabric layer to a next start point and the next iteration of the above method is performed starting from that fabric layer and corresponding needle bed. The terms "first" and "second" are arbitrary and change depending on which fabric layer and corresponding needle bed knitting begins. For example, the fabric layer of the yarn 506 of FIG. 5A may be referred to as the first fabric layer or the second fabric layer. Similarly, the fabric layer of the yarn 508 may be referred to as the first fabric layer or the second fabric layer.

The above-described operations are meant to be illustrative examples. The operations may be performed sequentially, synchronously, simultaneously, continuously, during overlapping time periods or in a different order depending upon the application. Also, any of the operations may not be performed or skipped depending on the implementation and/or sequence of events.

Figure 7:
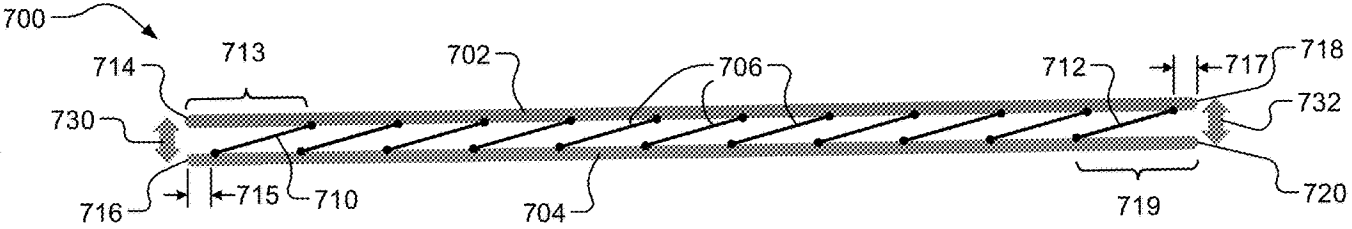
FIG. 7 is a top view and/or cross-section of a spacer fabric while knitting in accordance with an embodiment of the present disclosure.
Figure 8:
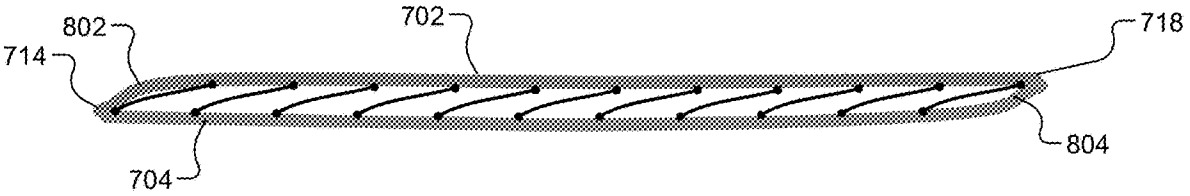
FIG. 8 is a top view of the spacer fabric of FIG. 7 illustrating closed ends in accordance with an embodiment of the present disclosure.

FIG. 7 is a top view and/or cross-section of a spacer fabric 700 while knitting in accordance with the method of FIG. 4. The spacer fabric 700 includes a first fabric layer 702, a second fabric layer 704, and tether segments 706 extending at acute angles relative to and between the fabric layers 702, 704. The tether segments 706 are shown as lines with attachment points at each end for illustrative purposes, but may be actuality formed as illustrated in FIGS. 3A and 3B. A first one of the tether segments 710 and a last one of the tether segments 712 are predetermined distances 713, 715, 717, 719 away from edges 714, 716, 718, 720 of the fabric layers 702, 704. Arrows 730, 732 indicate that the fabric layers 702, 704 are able to be moved away from each other. The edges 714, 716 are able to be stitched together and the edges 718, 720 are able to be stitched together. This is shown in FIG. 8, which shows the spacer fabric 700 with stitched (or closed) ends of the fabric layers 702, 704. The lengths of material 802, 804, referred to as untethered end portions, associated with the distances 713, 719 are able to be curled to be stitched to the edges 716, 718. The result is a multilayer tethered textile (or spacer fabric).

Figure 9:
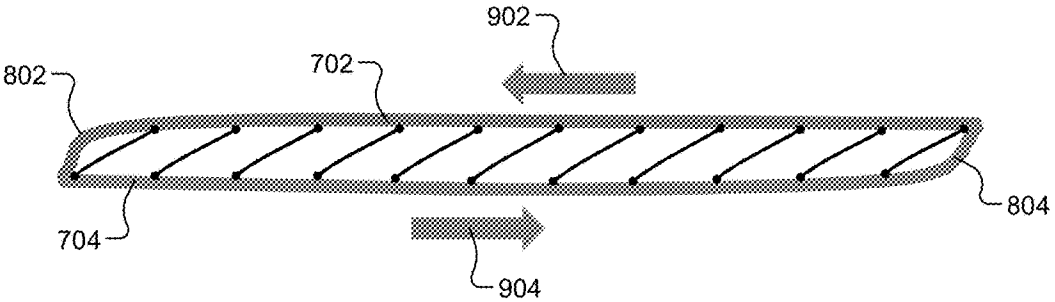
FIG. 9 is a top view of the spacer fabric of FIG. 7 illustrating folding over of untethered end regions in accordance with an embodiment of the present disclosure.
Figure 10:
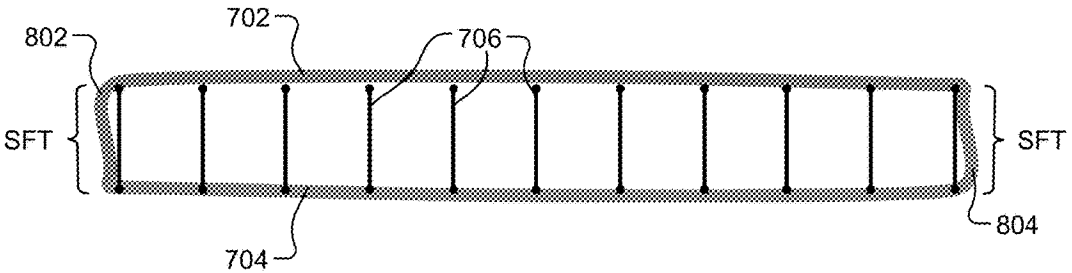
FIG. 10 is a top view of the spacer fabric of FIG. 7 illustrated in an erected state in accordance with an embodiment of the present disclosure.

FIG. 9 shows the spacer fabric 700 with the fabric layers 702, 704 being shifted laterally relative to each other as represented by arrows 902, 904. The untethered end portions 802, 804 are in a folded over state. FIG. 10 shows the spacer fabric 700 in an erected state. The fabric layers 702, 704 are fully spaced apart and the tether segments 706 are approximately perpendicular relative to the fabric layers 702, 704. The untethered end portions 802, 804 provide end surfaces of the spacer fabric 700. The spacer fabric 700 has the resultant spacer fabric thickness SFT. The SFT of FIG. 10 is different than the SFT of FIG. 1.

The above disclosed spacer fabrics may be formed of air tight materials and provide a resultant sealed structure. The sealed structures may be used to form inflatable objects, such as rafts, inflatable boats and/or other inflatable objects. The inflatable objects may not be water and/or marine related.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Although the terms first, second, third, etc. may be used herein to describe various tethers, tether segments, needles, needle beds, fabric layers, and/or other elements, these tethers, tether segments, needles, needle beds, fabric layers, and/or other elements should not be limited by these terms, unless otherwise indicated. These terms may be only used to distinguish one tether, tether segment, needles needle bed, fabric layer, and/or element from another tether, tether segment, needle, needle bed, fabric layer, and/or element. Terms such as "first," "second," and other numerical terms when used herein may not imply a sequence or order unless clearly indicated by the context. Thus, a first tether, tether segment, needle, needle bed, fabric layer, and/or element discussed herein could be termed a second tether, tether segment, needle, needle bed, fabric layer, and/or element without departing from the teachings of the example embodiments.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A method of forming a spacer fabric, the method comprising:

performing, via a knitting machine, an iterative process a plurality of times to form a plurality of tether segments, the iterative process comprising knitting a tether from a first point to a second point on a first fabric layer, extending the tether from the second point to a third point on a second fabric layer to start formation of one of the plurality of tether segments, temporarily holding the tether at the third point via one of a plurality of temporary holding needles, extending the tether from the third point to a fourth point on the first fabric layer, temporarily holding the tether at the fourth point via another one of the plurality of temporary holding needles, extending the tether from the fourth point to a fifth point on the second fabric layer to complete formation of the one of the plurality of tether segments, and knitting the tether from the fifth point to a final point on the second fabric layer; and releasing the plurality of tether segments from the temporary holding needles to allow a distance between the first fabric layer and the second fabric layer to increase.

2. The method of claim 1, wherein the iterative process comprises temporarily holding the one of the plurality of tether segments at only two temporary holding needles.

3. The method of claim 1, wherein the iterative process comprises temporarily holding the one of the plurality of tether segments at more than two temporary holding needles.

4. The method of claim 1, wherein the first fabric layer, the second fabric layer and the plurality of tether segments are formed of a same material.

5. The method of claim 1, wherein at least one of:

the plurality of tether segments are formed of a different material than the first fabric layer and the second fabric layer; or some of the plurality of tether segments are formed of a different material than other ones of the plurality of tether segments.

6. The method of claim 1, wherein the iterative process comprises:

determining a first number of needles to knit the tether on the first fabric layer;

determining a second number of needles to knit the tether on the second fabric layer;

knitting the tether to the first fabric layer using the first number of needles; and knitting the tether to the second fabric layer using the second number of needles.

7. The method of claim 1, wherein the iterative process comprises:

determining a number of needles the third point is to be offset from the second point; and extending the tether from the second point to the third point based on the number of needles.

8. The method of claim 1, wherein the iterative process comprises:

determining a number of needles the fourth point is to be offset from the third point; and extending the tether from the third point to the fourth point based on the number of needles.

9. The method of claim 1, wherein the iterative process comprises:

determining a number of needles the fifth point is to be offset from the fourth point; and extending the tether from the fourth point to the fifth point based on the number of needles.

10. The method of claim 1, wherein a different tether is used for each iteration of the iterative process.

11. The method of claim 1, wherein the tether is knitted to:

every other one of a portion of needles in a first bed of needles corresponding to the first fabric layer; and every other one of a portion of needles in a second bed of needles corresponding to the second fabric layer.

12. A method of forming a spacer fabric, the method comprising:

performing, via a knitting machine, an iterative process a plurality of times to form a plurality of tether segments, the iterative process comprising attaching a tether at a first point on a first fabric layer, knitting the tether from the first point to a second point on the first fabric layer, extending the tether from the second point to a third point to form one of the plurality of tether segments, wherein the third point is laterally offset from the second point and is on a second fabric layer, attaching the tether at the third point, extending the tether from the third point back to the second point on the first fabric layer to form a second one of the plurality of tether segments, attaching the tether at the second point, and knitting the tether from the second point to a final point on the second fabric layer; and shifting the first fabric layer relative to the second fabric layer to increase angles between (i) the plurality of tether segments and (ii) the first fabric layer and the second fabric layer, and allow distance between the first fabric layer and the second fabric layer to increase.

13. The method of claim 12, wherein a same tether is used for each iteration of the iterative process.

14. The method of claim 12, wherein the tether segments are angled is a same direction relative to the first fabric layer and the second fabric layer.

15. The method of claim 12, wherein the first fabric layer, the second fabric layer and the plurality of tether segments are formed of a same material.

16. The method of claim 12, wherein at least one of:

the plurality of tether segments are formed of a different material than the first fabric layer and the second fabric layer; or some of the plurality of tether segments are formed of a different material than other ones of the plurality of tether segments.

17. The method of claim 12, further comprising forming maintaining predetermined distances between edges of the first fabric layer and the second fabric layer and the plurality of tether segments to allow non-tethered end portions of the first fabric layer and the second fabric layer to be folded over and stitched.

18. The method of claim 17, wherein the non-tethered end portions form end surfaces of the spacer fabric when the spacer fabric is in an erected state.

19. The method of claim 12, wherein the iterative process further comprises:

determining a number of needles the second point is to be offset from the first point; and extending the tether from the first point to the second point based on the number of needles.

20. The method of claim 12, wherein the iterative process further comprises:

determining a number of needles between sets of tether segments; and extending the tether between the first point and the second point for iterations of the iterative process, other than a first iteration of the iterative process, based on the number of needles.

* * * * *